US011649653B2

(12) United States Patent
Zheng et al.

(10) Patent No.: US 11,649,653 B2
(45) Date of Patent: May 16, 2023

(54) SPRING-LOADED PLUG INSERT AND AN OUTDOOR SHELTER INCLUDING THE SAME

(71) Applicant: Sunjoy Industries Group Ltd., Steubenville, OH (US)

(72) Inventors: Gao Zheng, Jiaxing (CN); Le Shao Yun, Jiaxing (CN)

(73) Assignee: Sunjoy Industries Group Ltd., Galena, OH (US)

( * ) Notice: Subject to any disclaimer, the term of this patent is extended or adjusted under 35 U.S.C. 154(b) by 0 days.

(21) Appl. No.: 17/138,544

(22) Filed: Dec. 30, 2020

(65) Prior Publication Data

US 2021/0198919 A1 Jul. 1, 2021

Related U.S. Application Data

(60) Provisional application No. 62/955,908, filed on Dec. 31, 2019.

(51) Int. Cl.
*E04H 15/64* (2006.01)

(52) U.S. Cl.
CPC ..... *E04H 15/64* (2013.01)

(58) Field of Classification Search
CPC ..... E04H 15/64; A45B 25/18
USPC ..... 135/33.5; 160/328, 329; 40/603
See application file for complete search history.

(56) References Cited

U.S. PATENT DOCUMENTS

| | | | | |
|---|---|---|---|---|
| 2,928,403 | A * | 3/1960 | Hoskins | E04H 15/60 135/98 |
| 3,388,712 | A * | 6/1968 | Taylor | E04H 15/28 135/94 |
| 4,259,974 | A * | 4/1981 | de Polo | A45B 25/14 135/26 |
| 5,284,172 | A * | 2/1994 | Teate, Jr. | A45B 19/06 135/27 |
| 7,974,004 | B2 * | 7/2011 | Maruyama | G03B 21/58 160/351 |
| 9,107,493 | B2 | 8/2015 | Pan et al. | |
| 9,200,655 | B2 | 12/2015 | Pan | |
| 9,243,422 | B2 | 1/2016 | Hunt et al. | |

(Continued)

FOREIGN PATENT DOCUMENTS

| | | | | |
|---|---|---|---|---|
| EP | 2502517 | A1 * | 9/2012 | A45B 19/06 |

*Primary Examiner* — Noah Chandler Hawk
(74) *Attorney, Agent, or Firm* — The Law Office of Patrick F. O'Reilly, III, LLC

(57) ABSTRACT

A spring-loaded plug insert for facilitating a fitting of a canopy over a frame member of an outdoor shelter is disclosed herein. The spring-loaded plug insert includes a base member defining a cavity, the base member configured to be inserted into an opening of the frame member of the outdoor shelter; a displaceable plug member slidably received within the cavity of the base member, the displaceable plug member including an end portion for attaching to the canopy of the outdoor shelter; and a spring member configured to bias the displaceable plug member in an extended position relative to the base member. The displaceable plug member is configured to be displaced by a user to a retracted position relative to the base member in order to facilitate the fitting of the canopy over the frame member of the outdoor shelter. An outdoor shelter including the spring-loaded plug insert also is disclosed.

18 Claims, 13 Drawing Sheets

(56) References Cited

U.S. PATENT DOCUMENTS

| | | | | |
|---|---|---|---|---|
| 9,474,415 | B2 | 10/2016 | Banal et al. | |
| 9,504,299 | B2 * | 11/2016 | Ma | A45B 25/02 |
| 9,556,639 | B2 | 1/2017 | Hunt et al. | |
| 9,637,948 | B2 * | 5/2017 | Choi | E04H 15/64 |
| 9,668,554 | B2 * | 6/2017 | Haythornthwaite | A45B 25/22 |
| 9,756,912 | B1 * | 9/2017 | Haythornthwaite | A45B 25/18 |
| 10,132,075 | B2 | 11/2018 | Banal et al. | |
| 10,184,264 | B2 | 1/2019 | Hunt et al. | |
| 10,202,783 | B2 | 2/2019 | Pan | |
| 10,214,938 | B2 | 2/2019 | Pan | |
| 10,316,584 | B1 | 6/2019 | Cooper | |
| 10,499,735 | B1 | 12/2019 | Cooper | |
| 10,633,883 | B2 | 4/2020 | Zhu | |
| 10,760,280 | B2 | 9/2020 | Pan et al. | |
| 10,760,296 | B2 | 9/2020 | Zhu | |
| D898,943 | S | 10/2020 | Zhu | |
| D914,240 | S | 3/2021 | Pan et al. | |
| 2006/0174929 | A1 * | 8/2006 | Tseng | E04H 15/46 135/159 |

* cited by examiner

SPRING-LOADED PLUG INSERT AND AN OUTDOOR SHELTER INCLUDING THE SAME

CROSS-REFERENCE TO RELATED APPLICATIONS

This patent application claims priority to, and incorporates by reference in its entirety, U.S. Provisional Patent Application No. 62/955,908, entitled "Spring-Loaded Plug Insert And An Outdoor Shelter Including The Same", filed on Dec. 31, 2019.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a spring-loaded plug insert and an outdoor shelter including the same. More particularly, the invention relates to a spring-loaded plug insert for an outdoor shelter that facilitates the installation of the roof canopy on the roof frame members of the outdoor shelter.

2. Background and Description of Related Art

Portable outdoor shelters, such as portable gazebos, are useful for a myriad of different applications. For example, outdoor gazebos are often used for backyard patio gathering spaces. Because the outdoor gazebos are at least partially enclosed, table and chair sets may be arranged underneath the outdoor gazebos so that the individuals seated around the table may remain cooler by being shaded from direct sunlight. Also, when food is being served outside, a food serving table or tables are often placed underneath the gazebo to protect the food from direct sunlight and rain.

Although, conventional outdoor shelters often require a great deal of time to assemble because they include a large collection of constituent components that must be assembled to one another. For example, the roof canopy of a conventional outdoor shelter is often difficult to install on the roof frame of the conventional outdoor shelter. As such, the overall time required to assemble the outdoor shelter is increased.

Therefore, what is needed is a spring-loaded plug insert for an outdoor shelter that facilitates the installation of the roof canopy on the roof frame members of the outdoor shelter. In addition, an outdoor shelter that includes the spring-loaded plug insert is needed that enables a user to more easily assemble the outdoor shelter in a shorter amount of time.

BRIEF SUMMARY OF EMBODIMENTS OF THE INVENTION

Accordingly, the present invention is directed to a spring-loaded plug insert and an outdoor shelter including the same that substantially obviates one or more problems resulting from the limitations and deficiencies of the related art.

In accordance with one or more embodiments of the present invention, there is provided a spring-loaded plug insert for facilitating a fitting of a canopy over a frame member of an outdoor shelter. The spring-loaded plug insert includes a base member defining a cavity, the base member configured to be inserted into an opening of the frame member of the outdoor shelter; a displaceable plug member slidably received within the cavity of the base member, the displaceable plug member including an end portion for attaching to the canopy of the outdoor shelter; and a spring member configured to bias the displaceable plug member in an extended position relative to the base member. In these one or more embodiments, the displaceable plug member is configured to be displaced by a user to a retracted position relative to the base member in order to facilitate the fitting of the canopy over the frame member of the outdoor shelter.

In a further embodiment of the present invention, the base member further comprises a base wall and a plurality of side walls extending outwardly from the base wall, at least one of the plurality of side walls comprising one or more rib members for creating a tighter fit between the base member and the opening of the frame member of the outdoor shelter.

In yet a further embodiment, at least one of the plurality of side walls of the base member comprises a longitudinally extending slot formed therein, and the displaceable plug member comprises a protrusion slidingly received within the longitudinally extending slot of the base member; and an engagement between the protrusion of the displaceable plug member and the longitudinally extending slot of the base member defines a range of the sliding movement of the displaceable plug member relative to the base member.

In still a further embodiment, the base member further comprises a peripheral rim disposed on an end of the plurality of side walls that is opposite to the base wall, the peripheral rim configured to prevent the over-insertion of the base member into the opening of the frame member of the outdoor shelter.

In yet a further embodiment, the base wall of the base member comprises a first spring protrusion extending outwardly from the base wall, and the displaceable plug member comprises a second spring protrusion extending outwardly from the displaceable plug member; and a first end of the spring member is supported by the first spring protrusion of the base member and a second end of the spring member is supported by the second spring protrusion of the displaceable plug member, the first end of the spring member being oppositely disposed relative to the second end of the spring member.

In still a further embodiment, the displaceable plug member further comprises a stem portion attached to the end portion of the displaceable plug member.

In yet a further embodiment, the end portion of the displaceable plug member further comprises a curved surface defining a finger recess for receiving a finger of the user when the user displaces the displaceable plug member to the retracted position.

In still a further embodiment, when the displaceable plug member is displaced by the user to the retracted position, the spring member is configured to be compressed.

In accordance with one or more other embodiments of the present invention, there is provided an outdoor shelter that includes at least one frame member having an opening; a canopy configured to be supported by the at least one frame member; and a spring-loaded plug insert for facilitating a fitting of the canopy over the at least one frame member of the outdoor shelter. The spring-loaded plug insert includes a base member defining a cavity, the base member configured to be inserted into the opening of the at least one frame member of the outdoor shelter; a displaceable plug member slidably received within the cavity of the base member, the displaceable plug member including an end portion for attaching to the canopy of the outdoor shelter; and a spring member configured to bias the displaceable plug member in an extended position relative to the base member. In these one or more other embodiments, the displaceable plug member is configured to be displaced by a user to a retracted position relative to the base member in order to facilitate the fitting of the canopy over the at least one frame member of the outdoor shelter.

In a further embodiment of the present invention, the base member of the spring-loaded plug insert further comprises a base wall and a plurality of side walls extending outwardly from the base wall, at least one of the plurality of side walls comprising one or more rib members for creating a tighter fit between the base member and the opening of the at least one frame member of the outdoor shelter.

In yet a further embodiment, at least one of the plurality of side walls of the base member of the spring-loaded plug insert comprises a longitudinally extending slot formed therein, and the displaceable plug member comprises a protrusion slidingly received within the longitudinally extending slot of the base member; and an engagement between the protrusion of the displaceable plug member and the longitudinally extending slot of the base member defines a range of the sliding movement of the displaceable plug member relative to the base member.

In still a further embodiment, the base member of the spring-loaded plug insert further comprises a peripheral rim disposed on an end of the plurality of side walls that is opposite to the base wall, the peripheral rim configured to prevent the over-insertion of the base member into the opening of the at least one frame member of the outdoor shelter.

In yet a further embodiment, the base wall of the base member of the spring-loaded plug insert comprises a first spring protrusion extending outwardly from the base wall, and the displaceable plug member comprises a second spring protrusion extending outwardly from the displaceable plug member; and a first end of the spring member is supported by the first spring protrusion of the base member and a second end of the spring member is supported by the second spring protrusion of the displaceable plug member, the first end of the spring member being oppositely disposed relative to the second end of the spring member.

In still a further embodiment, the displaceable plug member of the spring-loaded plug insert further comprises a stem portion attached to the end portion of the displaceable plug member.

In yet a further embodiment, the end portion of the displaceable plug member of the spring-loaded plug insert further comprises a curved surface defining a finger recess for receiving a finger of the user when the user displaces the displaceable plug member to the retracted position.

In still a further embodiment, when the displaceable plug member of the spring-loaded plug insert is displaced by the user to the retracted position, the spring member of the spring-loaded plug insert is configured to be compressed.

In yet a further embodiment, the canopy further comprises at least one pocket structure, the at least one pocket structure defining a pocket cavity configured to receive the end portion of the displaceable plug member of the spring-loaded plug insert therein.

In still a further embodiment, the canopy of the outdoor shelter comprises a roof canopy, the at least one frame member of the outdoor shelter comprises a roof frame member, and the end portion of the displaceable plug member attaches the roof canopy to the roof frame member of the outdoor shelter.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
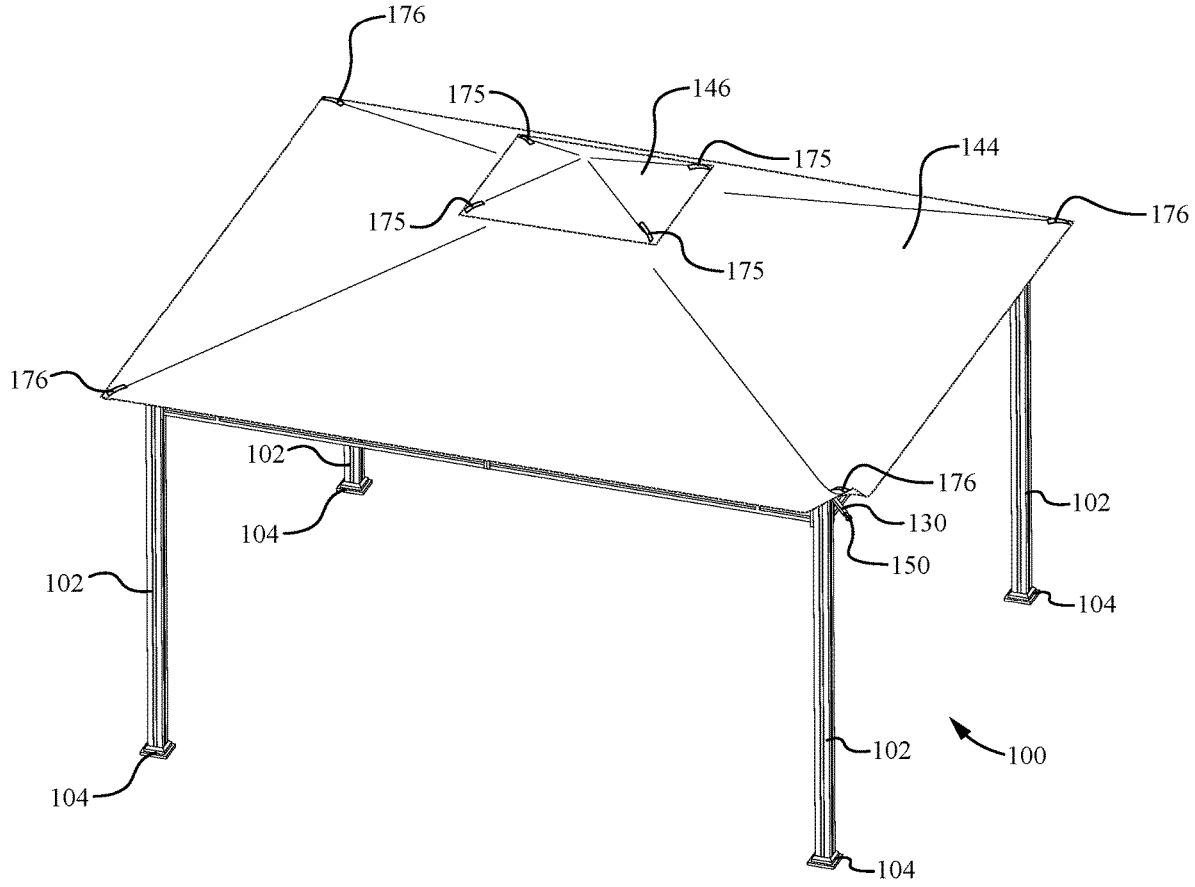
FIG. 1 is a perspective view of an outdoor shelter with a roof canopy, according to an illustrative embodiment of the invention.
Figure 2:
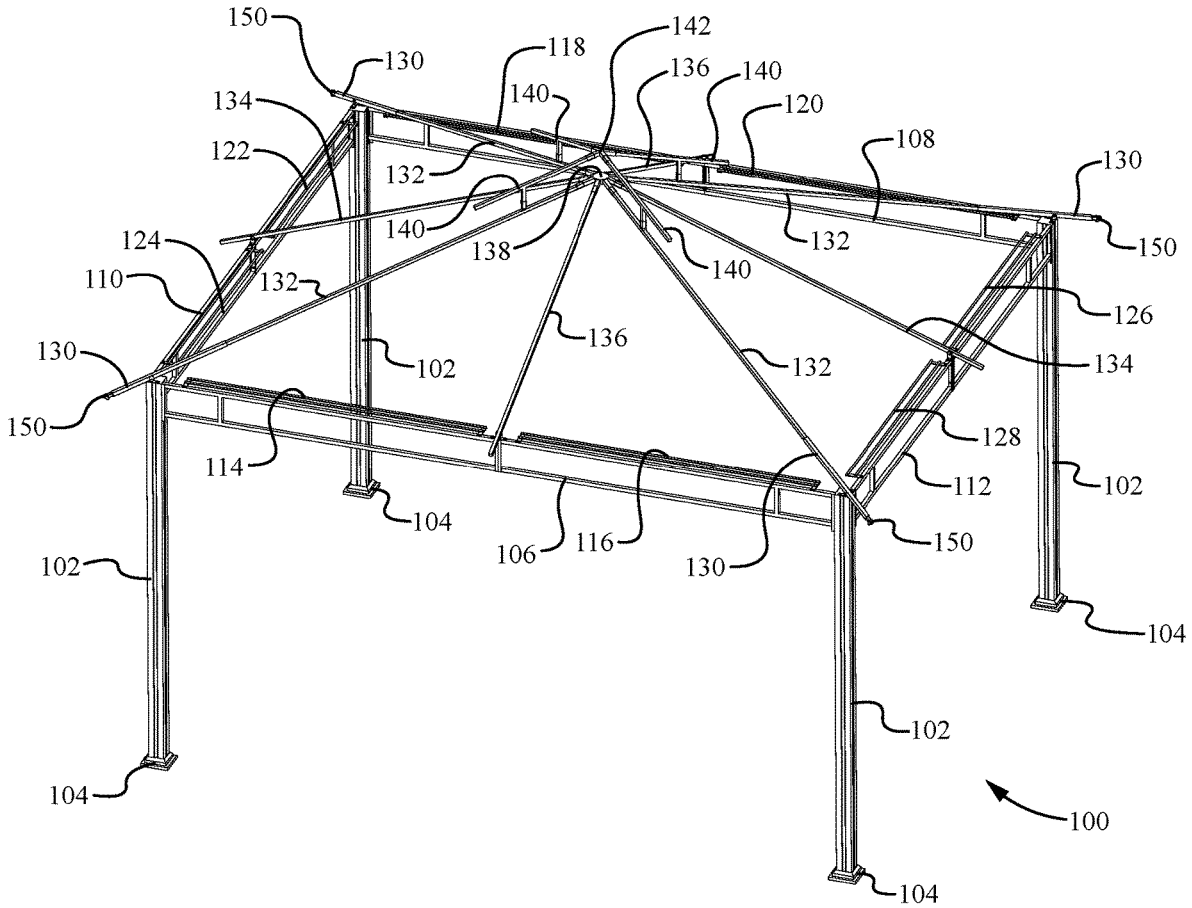
FIG. 2 is another perspective view of the outdoor shelter of FIG. 1, wherein the roof canopy has been removed from the outdoor shelter so as to better illustrate the frame members of the outdoor shelter.

An illustrative embodiment of an outdoor shelter in the form of a gazebo is seen generally at 100 in FIGS. 1 and 2. In particular, referring to the perspective views of FIGS. 1 and 2, it can be seen that the outdoor shelter 100 generally comprises a plurality of corner support members (e.g., corner support post members 102); a plurality of crossbeam members 106, 108, 110, 112, each of the crossbeam members 106, 108, 110, 112 configured to be connected between a pair of corner support post members 102; a plurality of roof frame members 130, 132, 134, 136, each of the roof frame members 130, 132, 134, 136 configured to be coupled to one of the plurality of corner support post members 102 or one of the plurality of crossbeam members 106, 108, 110, 112; and a roof canopy 144, 146 configured to be supported by the plurality of roof frame members 130, 132, 134, 136. The details of the roof canopy 144, 146 of the outdoor shelter 100 will be described hereinafter.

As shown in FIGS. 1 and 2, the corner support members of the illustrated outdoor shelter 100 are in the form of corner support post members 102. With reference to these figures, it can be seen that each of the corner support post members 102 is provided with a respective post base cover 104 at the bottom end of each corner support post member 102.

Now, with reference again to the illustrative embodiment of FIGS. 1 and 2, the crossbeam members 106, 108, 110, 112 of the outdoor shelter 100 will be described. As shown in these figures, the outdoor shelter 100 includes a pair of first longitudinal crossbeam members 106, 108 and a pair of second transverse crossbeam members 110, 112. The first longitudinal crossbeam members 106, 108 are essentially the same as the second transverse crossbeam members 110, 112, except that the first longitudinal crossbeam members 106, 108 have a longer length than the second transverse crossbeam members 110, 112 (the outdoor shelter 100 has a generally rectangular shape with two longer sides and two shorter sides). As shown in FIGS. 1 and 2, each of the crossbeam members 106, 108, 110, 112 may include a linear bottom member that is connected to a linear top member by a plurality of spaced-apart vertical members.

Next, turning again to FIGS. 1 and 2, the roof frame members 130, 132, 134, 136 of the illustrative embodiment of the outdoor shelter 100 will be explained. In general, it can be seen that the roof frame members 130, 132, 134, 136 are circumferentially spaced apart from one another so as to form a supporting structure for the roof canopy 144, 146. An upper end of each of the roof frame members 132, 134, 136 is designed to be inserted into a respective outwardly extending tubular member of a large roof central connecting member 138 (see FIG. 2). As shown in FIG. 2, the large roof central connecting member 138 has a central body portion with a plurality of peripheral tubular members extending outwardly therefrom. As such, the lower central connecting member 138 generally resembles an octopus, wherein the central body portion forms the body of the octopus and the peripheral tubular members form the legs of the octopus. As shown in FIG. 2, each of the roof frame members 132, 134, 136 engages with a respective one of the peripheral tubular members of the large roof central connecting member 138 so that a generally rigid roof structure is formed thereby.

In the illustrative embodiment, the roof framing members of the outdoor shelter 100 include two (2) middle roof frame members 134 having a first length, two (2) middle roof frame members 136 having a second length, four (4) corner roof frame members 132, and four (4) corner roof frame end members 130. As shown in FIG. 2, the first length of the middle roof frame members 134 is greater than the second length of the middle roof frame members 136. The corner roof frame end members 130 are provided with open end portions having larger cross-sectional sizes than the cross-sectional sizes of the corner roof frame members 132 so that they are capable of receiving a lower end portion of a respective corner roof frame member 132. That is, the corner roof frame end members 130 attach to the lower ends of the corner roof frame members 132, thereby extending their overall length.

Next, referring again to FIG. 2, it can be seen that the outdoor shelter 100 further includes a plurality of small roof corner frame members 140. In FIG. 2, it can be seen that each corner roof frame member 132 comprises an upwardly extending tubular portion for engaging a downwardly extending tubular portion of a respective small roof corner frame member 140 (i.e., each downwardly extending tubular portion of the small roof corner frame member 140 is inserted into a respective open end of the upwardly extending tubular portion of the corner roof frame member 132). As shown in FIG. 2, each small roof corner frame member 140 is spaced apart from the respective corner roof frame member 132 by the upwardly extending tubular portion and the downwardly extending tubular portion, thereby forming the gap for the roof vent of portable shelter 100. With reference again to FIG. 2, it can be seen that an upper end of each of the small roof corner frame members 140 is designed to be coupled to an outwardly extending tubular member of a small roof central connecting member 142. In one or more embodiments, the roof vent of the outdoor shelter 100 may be provided with roof vent netting there-around in order to prevent birds and large insects from entering the interior of the outdoor shelter 100 through the roof vent.

Initially, referring again to FIGS. 1 and 2, the roof canopy 144, 146 and other features of the outdoor shelter 100 will now be described. As best shown in FIGS. 1 and 2, a peripheral roof canopy portion 144 covers a majority of the roof framing system, while a central roof canopy portion 146 is disposed over the small roof corner frame members 140 that form the roof vent of the outdoor shelter 100. Together the peripheral roof canopy portion 144 and the central roof canopy portion 146 form the roof of the outdoor shelter 100.

Also, as shown in the illustrative embodiment of FIG. 2, the outdoor shelter 100 may be provided with a plurality of netting support members 114, 116, 118, 120, 122, 124, 126, 128 that provide a support structure for side curtain netting of the outdoor shelter 100. The side curtain netting may be designed to permit airflow therethrough, yet keep insects from entering the interior of the outdoor shelter 100. The side curtain netting may be supported from the netting support members 114, 116, 118, 120, 122, 124, 126, 128 of the outdoor shelter 100 by fastening straps or other suitable fastening members. In the illustrative embodiment, the netting support members of the outdoor shelter 100 include four (4) long netting support members 114, 116, 118, 120 having a first length and four (4) short netting support members 122, 124, 126, 128 having a second length, wherein the first length of the netting support members 114, 116, 118, 120 is greater than the second length of the netting support members 122, 124, 126, 128.

Now, with reference to FIGS. 1 and 14-16, the details of the peripheral roof canopy portion 144 of the outdoor shelter 100 will be explained. In the illustrative embodiment, the peripheral roof canopy portion 144 includes a canopy fabric material (e.g., a polyester fabric—see FIG. 1) configured to form a roof cover of the outdoor shelter 100, the canopy fabric material having a first surface configured to face outwardly away from an interior of the outdoor shelter 100 and a second surface configured to face inwardly toward the interior of the outdoor shelter 100, the first surface being oppositely disposed relative to the second surface; a plurality of pocket structures 178 (see e.g., FIGS. 14-16) attached to the second surface of the canopy fabric material, each one of the plurality of pocket structures 178 including a pocket fabric sheet at least partially spaced apart from the canopy fabric material, the pocket fabric sheet and the canopy fabric material together defining a pocket cavity (see FIG. 16) configured to receive an end portion of a roof frame member 130 of the outdoor shelter 100 therein (see FIG. 16); and a plurality of handle members 176 attached to the first surface (see e.g., FIGS. 1 and 14-16) of the canopy fabric material, each one of the plurality of handle members 176 overlapping the canopy fabric material that partially defines the pocket cavity, and each one of the plurality of handle members 176 configured to be grasped by a user so as to facilitate a respective one of the pocket structures 178 being fitted over a respective one of the roof frame member end portions. In the illustrative embodiment, referring to FIG. 1, it can be seen that the canopy fabric material forming the peripheral roof canopy portion 144 comprises a plurality of corners (i.e., four (4) corners), and each of the plurality of pocket structures 178 is disposed in a respective one of the plurality of corners (i.e., each corner includes a pocket structure 178). Also, in the illustrative embodiment, a handle member 176 may be provided above each of the corner pockets 178 so as to facilitate the engagement of each pocket 178 with its respective roof frame member end portion. In addition, in the illustrative embodiment, a pocket structure may also be provided in approximately the middle of each side of the peripheral roof canopy portion 144 so as to accommodate a respective lower end portion of a middle roof frame member 134, 136. That is, each of these four (4) additional pocket structures is approximately centered between the corners of the canopy fabric material forming the peripheral roof canopy portion 144. Similar to the corner pockets 178, each of these middle pockets may be provided with a handle member disposed thereabove in order to facilitate the engagement of each middle pocket with its respective middle roof frame member end portion.

In the illustrated embodiment, the central roof canopy portion 146, which forms the top cover of the roof vent of the outdoor shelter 100, may comprise handle members and pocket structures in the corners thereof that are similar to the handle members 176 and pocket structures 178 described above for peripheral roof canopy portion 144. In particular, as shown in FIG. 1, the central roof canopy portion 146 may comprise a handle member 175 disposed in each of the four (4) corners of the central roof canopy portion 146. Similar to that explained above for the peripheral roof canopy portion 144, the handle members 175 may be grasped by a user so as to facilitate a respective one of the pocket structures of the central roof canopy portion 146 being fitted over a respective one of the end portions of small roof corner frame members 140.

In the illustrative embodiment, the constituent components of the framing system of the outdoor shelter 100 (e.g., as illustrated in FIGS. 1 and 2) are formed from a suitable metallic material, such as steel, while the roof canopy portions 144, 146, the handle members 175, 176, and the pocket structures 178 are all formed from a suitable fabric, such as a polyester fabric material. However, those of ordinary skill in the art will appreciate that other suitable materials can be used for the various components of the outdoor shelter 100 as well. In the illustrative embodiment, the canopy fabric material forming the roof canopy portions 144, 146 is stretchable so that the canopy fabric material is capable of being elastically deformed by the user as the pocket structure is fitted over the end portions of the roof frame members.

Now, referring primarily to the illustrative embodiment of FIGS. 3, 4, and 11, the spring-loaded plug inserts 150 of the outdoor shelter 100 will be described in detail. The spring-loaded plug inserts 150 facilitate a fitting of the roof canopy 144 over the roof frame members 130 of the outdoor shelter 100. In particular, referring to FIGS. 3, 4, and 11, it can be seen that each of the spring-loaded plug inserts 150 generally comprises a base member 152 defining a cavity 160, the base member 152 configured to be inserted into an opening 131 of the roof frame member 130 of the outdoor shelter 100 (see e.g., FIG. 12); a displaceable plug member 164 slidably received within the cavity 160 of the base member 152, the displaceable plug member 164 including an end portion 170 for attaching to the roof canopy 144 of the outdoor shelter 100; and a spring member 162 configured to bias the displaceable plug member 164 in an extended position relative to the base member 152 (e.g., the extended position depicted in FIG. 13A). In the illustrative embodiment, each displaceable plug member 164 is configured to be displaced by a user to a retracted position relative to the base member 152 (e.g., the retracted position depicted in FIG. 13B) in order to facilitate the fitting of the roof canopy 144 over the roof frame member 130 of the outdoor shelter 100.

With combined reference to the illustrative embodiment of FIGS. 3 and 11, the base member 152 of each spring-loaded plug insert 150 will be explained in further detail. As shown in these figures, the base member 152 further comprises a base wall 153 and a plurality of side walls extending outwardly from the base wall 153. Each of the plurality of side walls includes a plurality of rib members 156 for creating a tighter fit between the base member 152 and the opening 131 of the roof frame member 130 of the outdoor shelter 100. Also, in the illustrative embodiment, each of the plurality of side walls of the base member 152 comprises a longitudinally extending slot 154 formed therein (see FIGS. 3 and 11). In the illustrative embodiment, the displaceable plug member 164 comprises corresponding angled protrusions 168 slidingly received within the respective longitudinally extending slots 154 of the base member 152 (refer to FIGS. 3-8, 11, 13A, and 13B). An engagement between the angled protrusions 168 of the displaceable plug member 164 and the respective longitudinally extending slots 154 of the base member 152 defines a range of the sliding movement of the displaceable plug member 164 relative to the base member 152.

Figure 3:
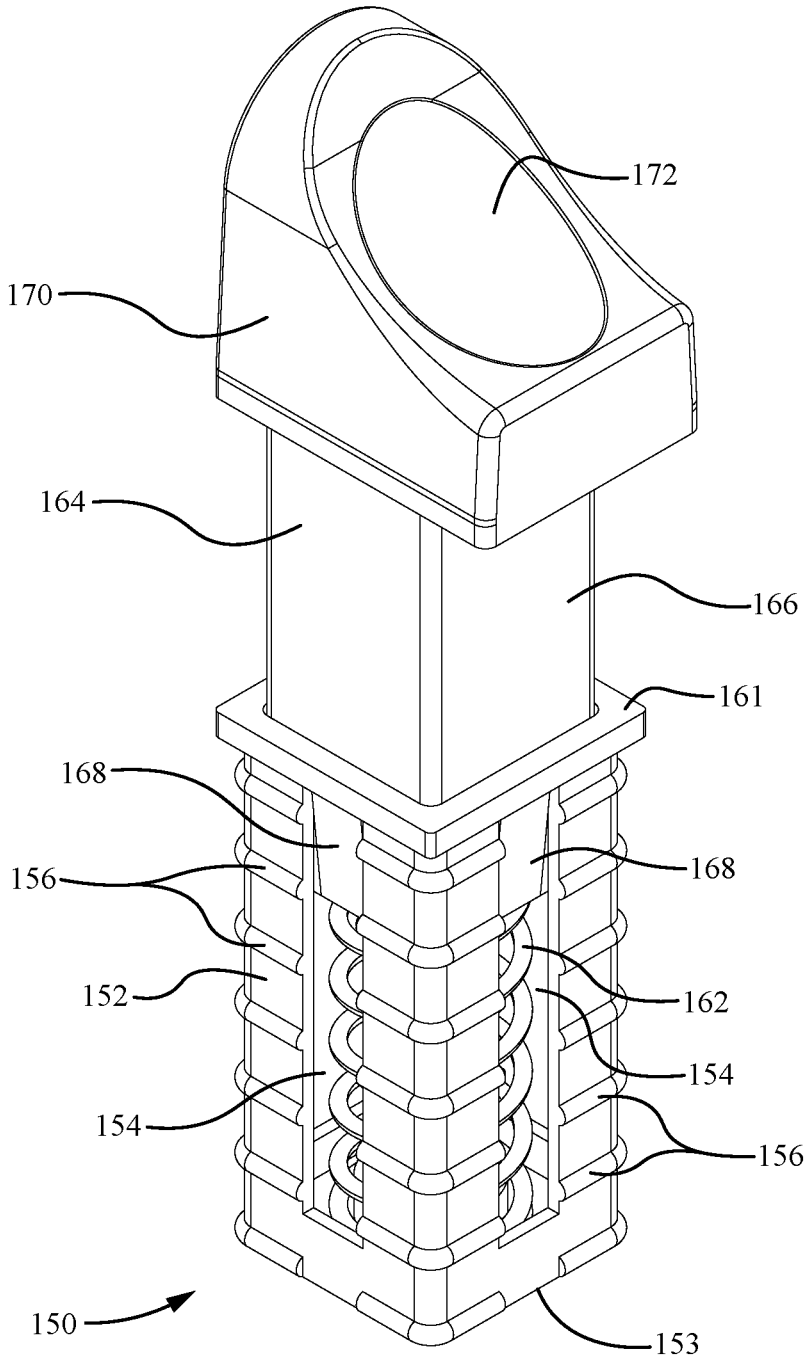
FIG. 3 is a perspective view illustrating one of the spring-loaded plug inserts of the outdoor shelter.
Figure 4:
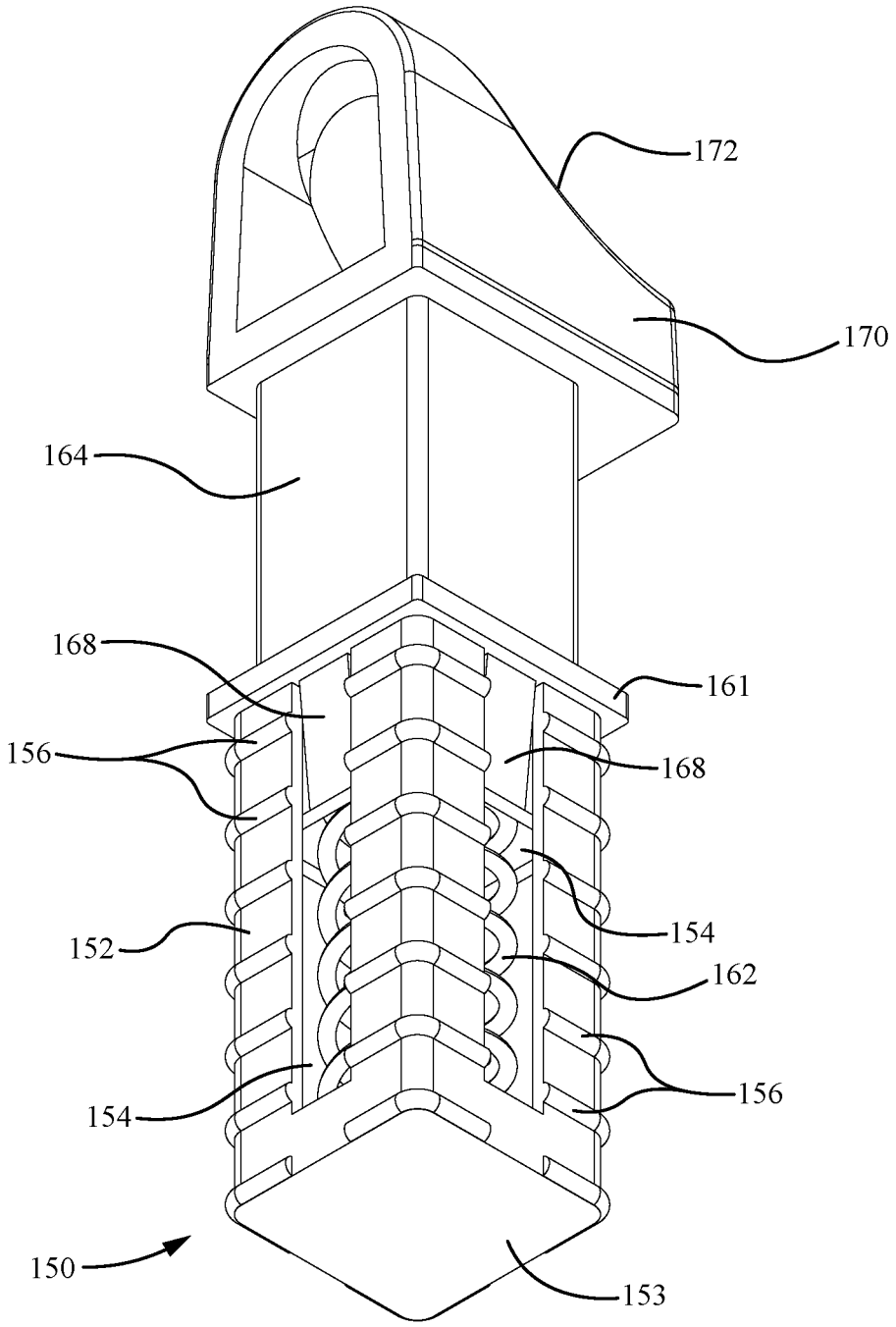
FIG. 4 is another perspective view of the spring-loaded plug insert of FIG. 3.
Figure 5:
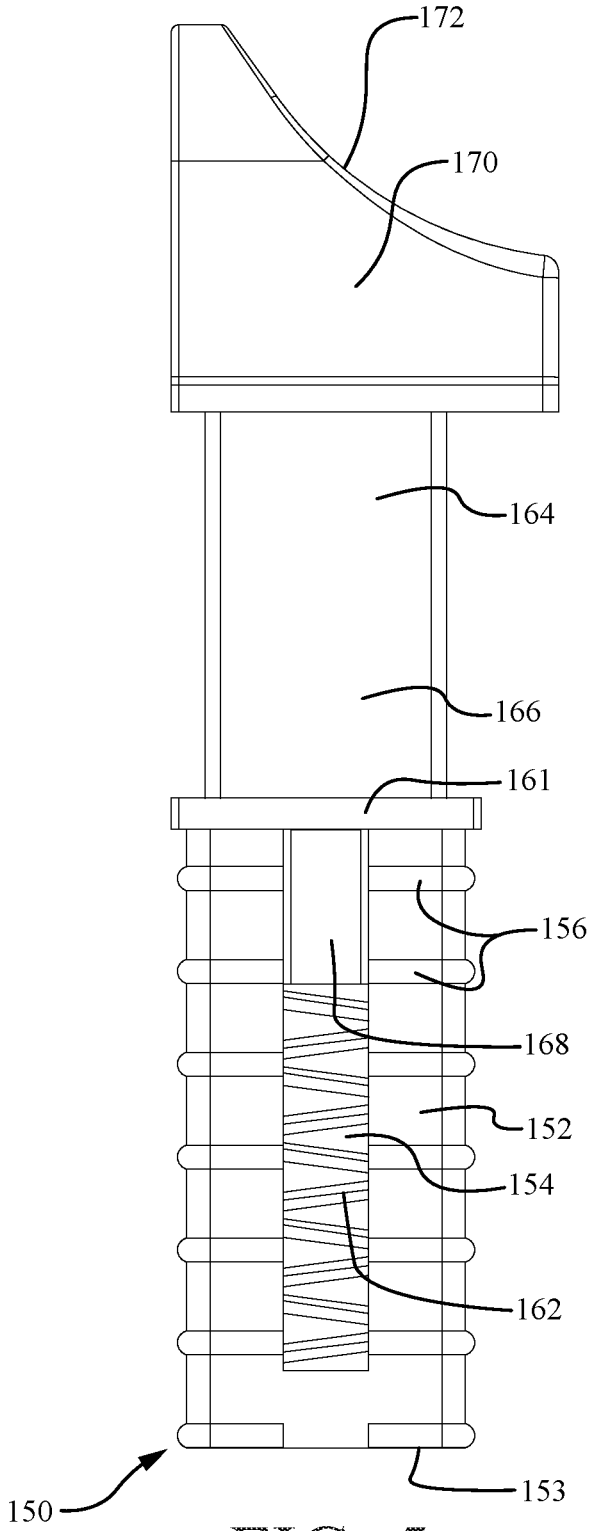
FIG. 5 is a first side elevational view of the spring-loaded plug insert of FIG. 3.
Figure 6:
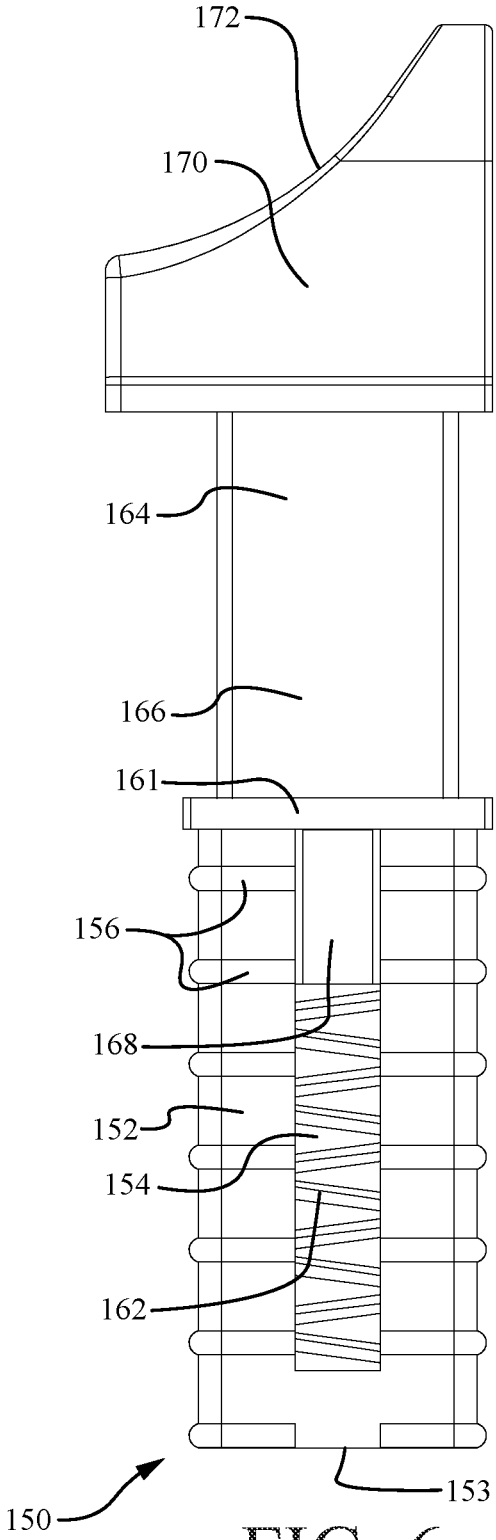
FIG. 6 is a second side elevational view of the spring-loaded plug insert of FIG. 3.
Figure 7:
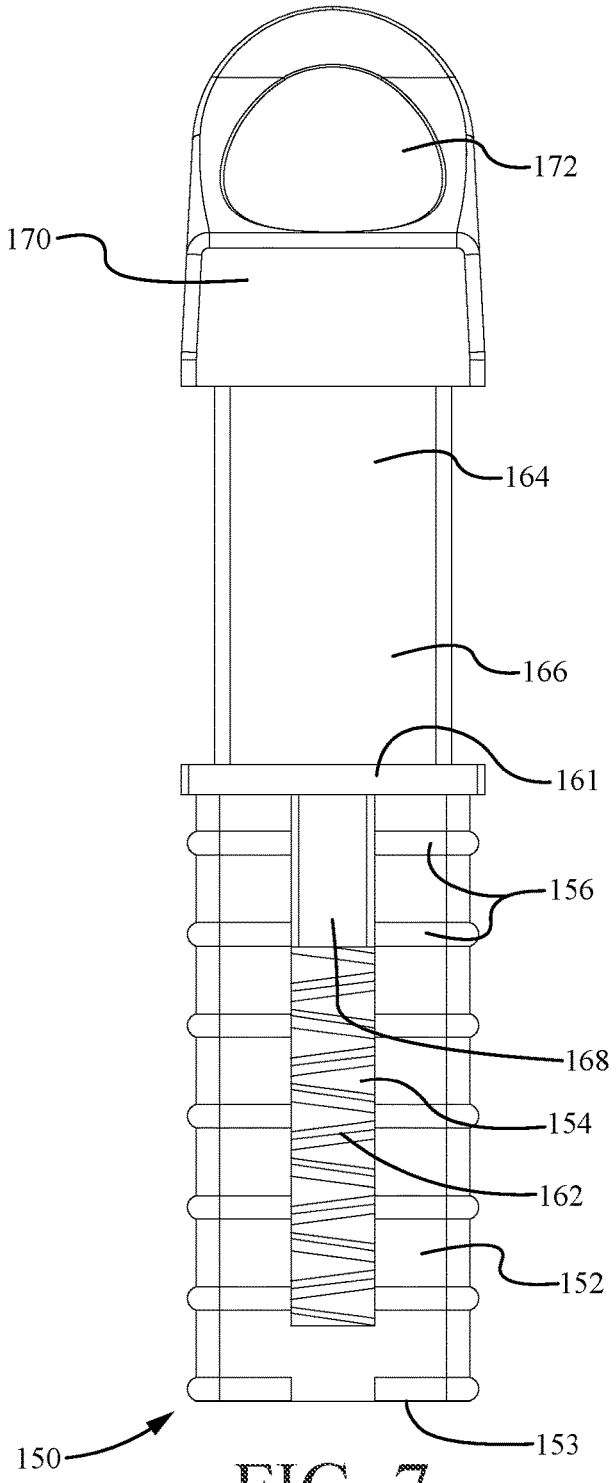
FIG. 7 is a bottom plan view of the spring-loaded plug insert of FIG. 3.
Figure 8:
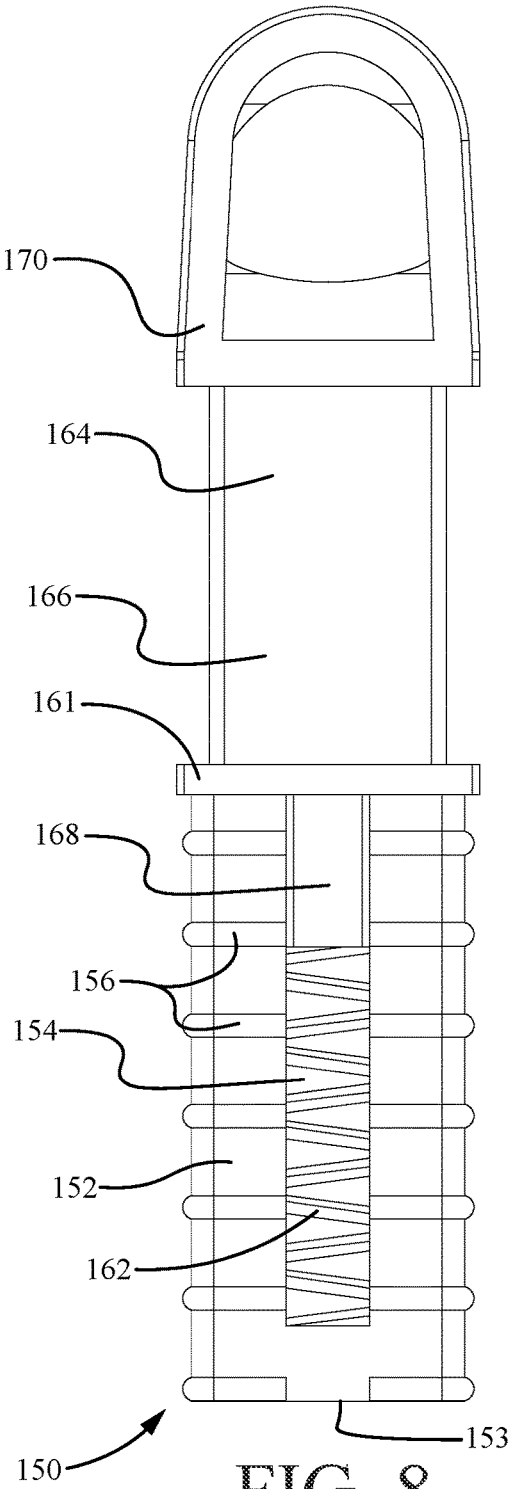
FIG. 8 is a top plan view of the spring-loaded plug insert of FIG. 3.
Figure 9:
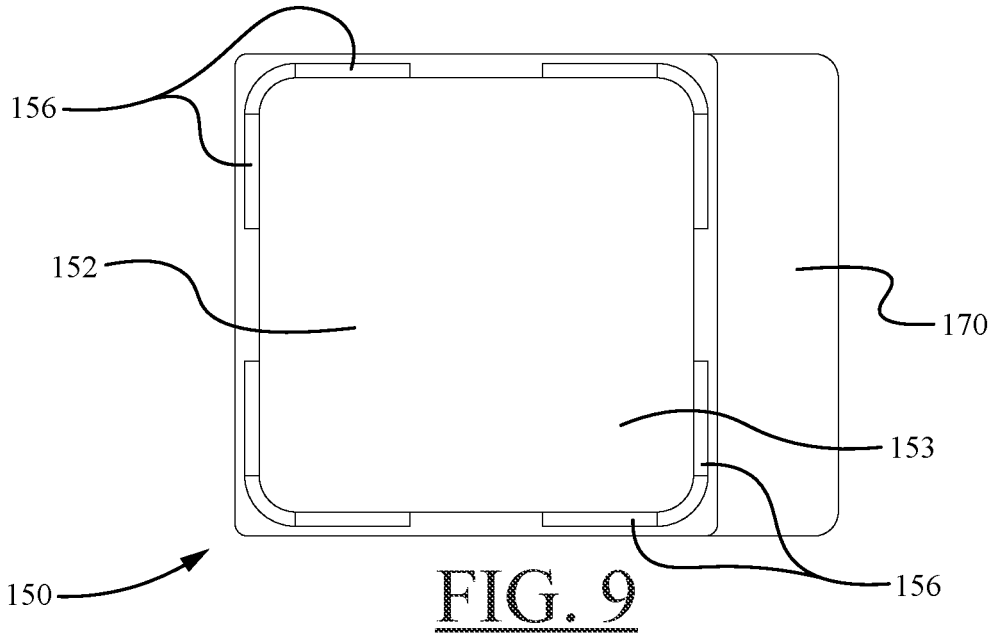
FIG. 9 is a first end view of the spring-loaded plug insert of FIG. 3.
Figure 10:
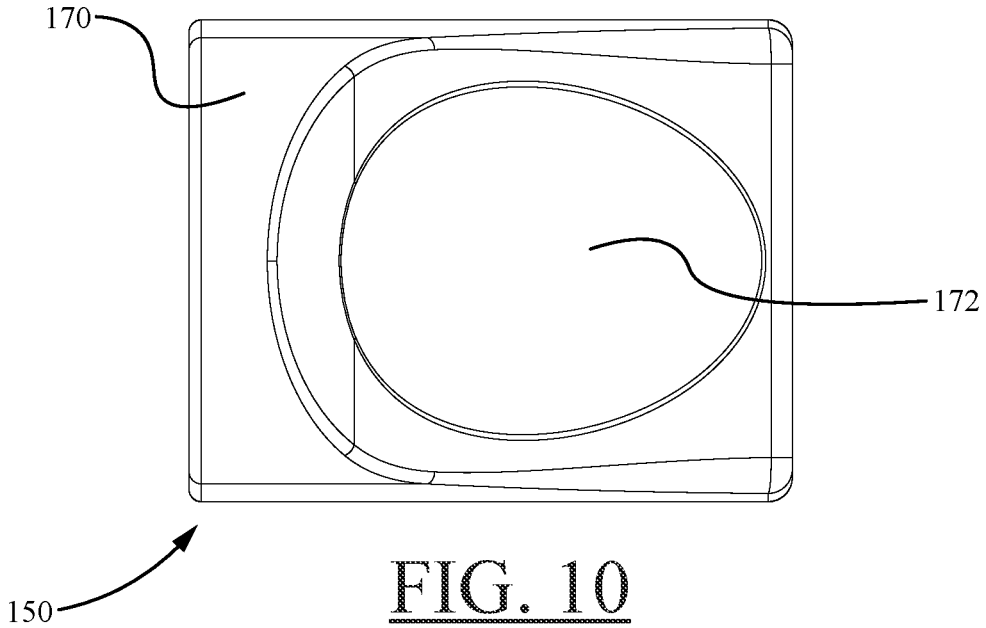
FIG. 10 is a second end view of the spring-loaded plug insert of FIG. 3.
Figure 11:
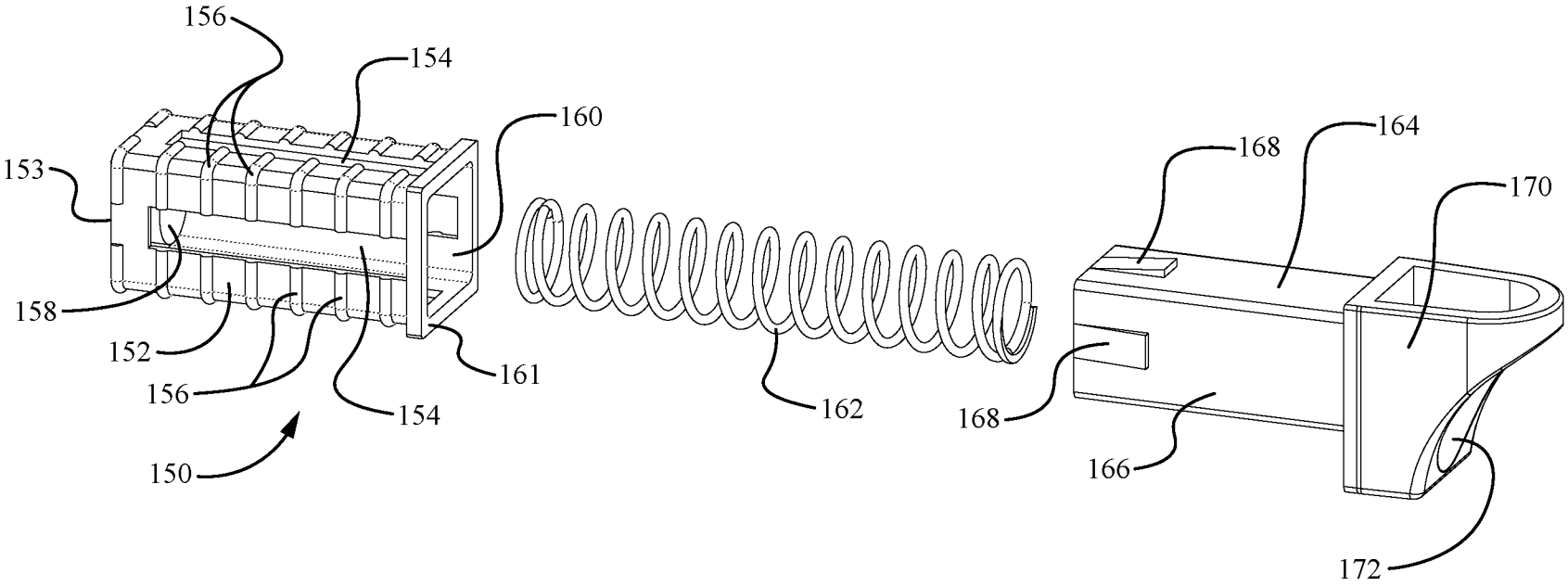
FIG. 11 is an exploded perspective view of the spring-loaded plug insert of FIG. 3.
Figure 12:
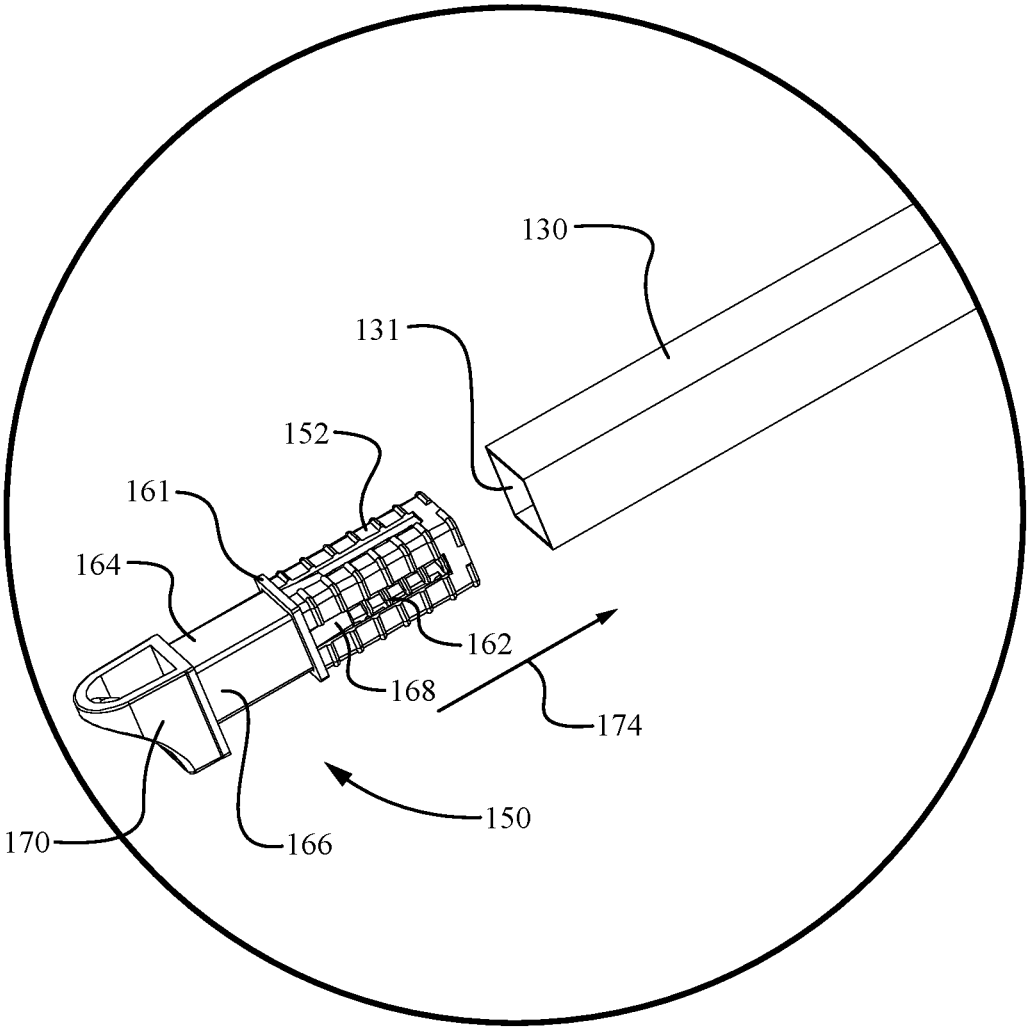
FIG. 12 is an enlarged, partial perspective view illustrating the insertion of a spring-loaded plug insert into an opening at an end of one of the roof frame members of the outdoor shelter of FIG. 1.
Figure 14:
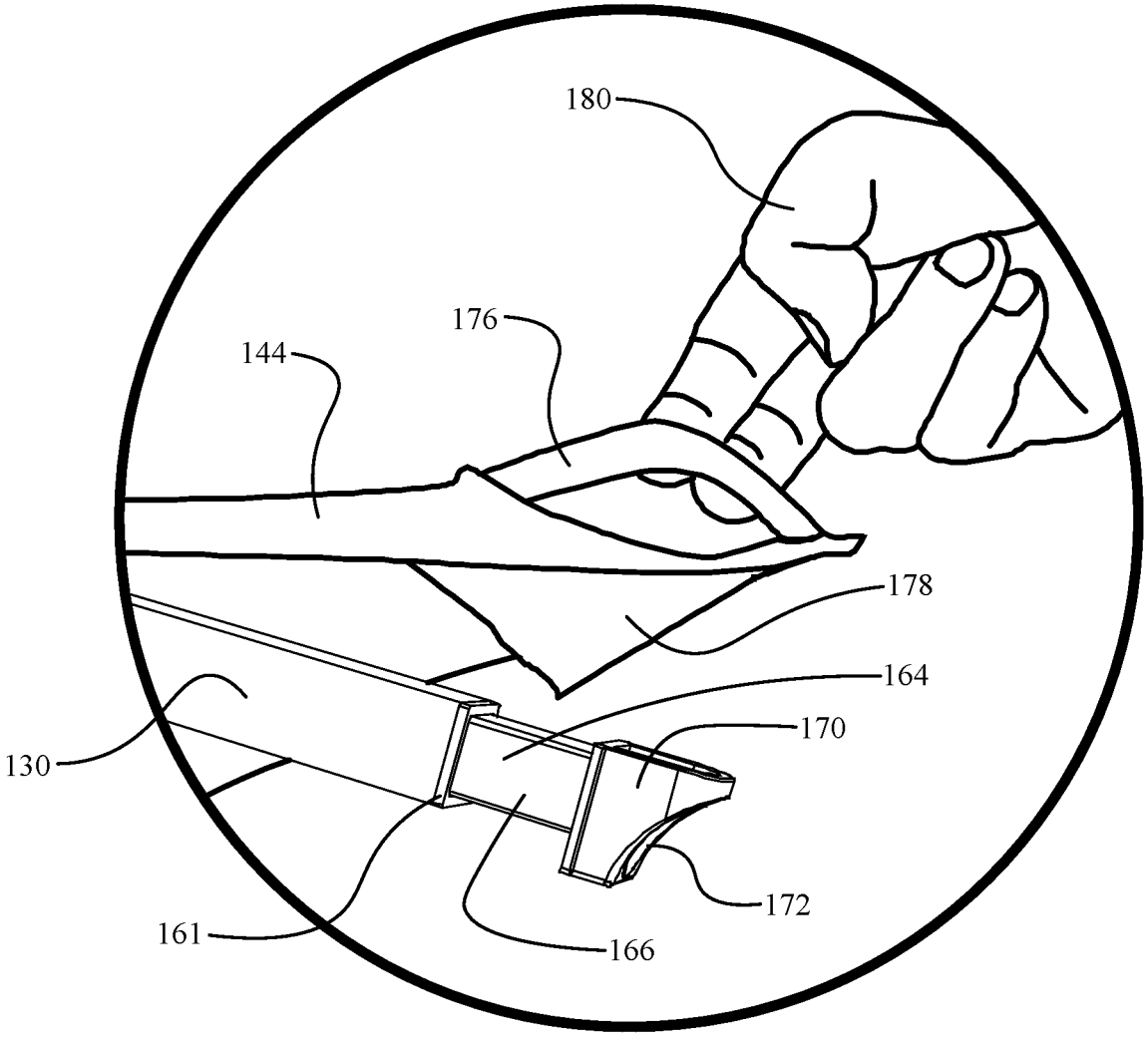
FIG. 14 is an enlarged, partial perspective view illustrating the manner in which a corner of the peripheral roof canopy portion in FIG. 1 is grasped by a user.
Figure 15:
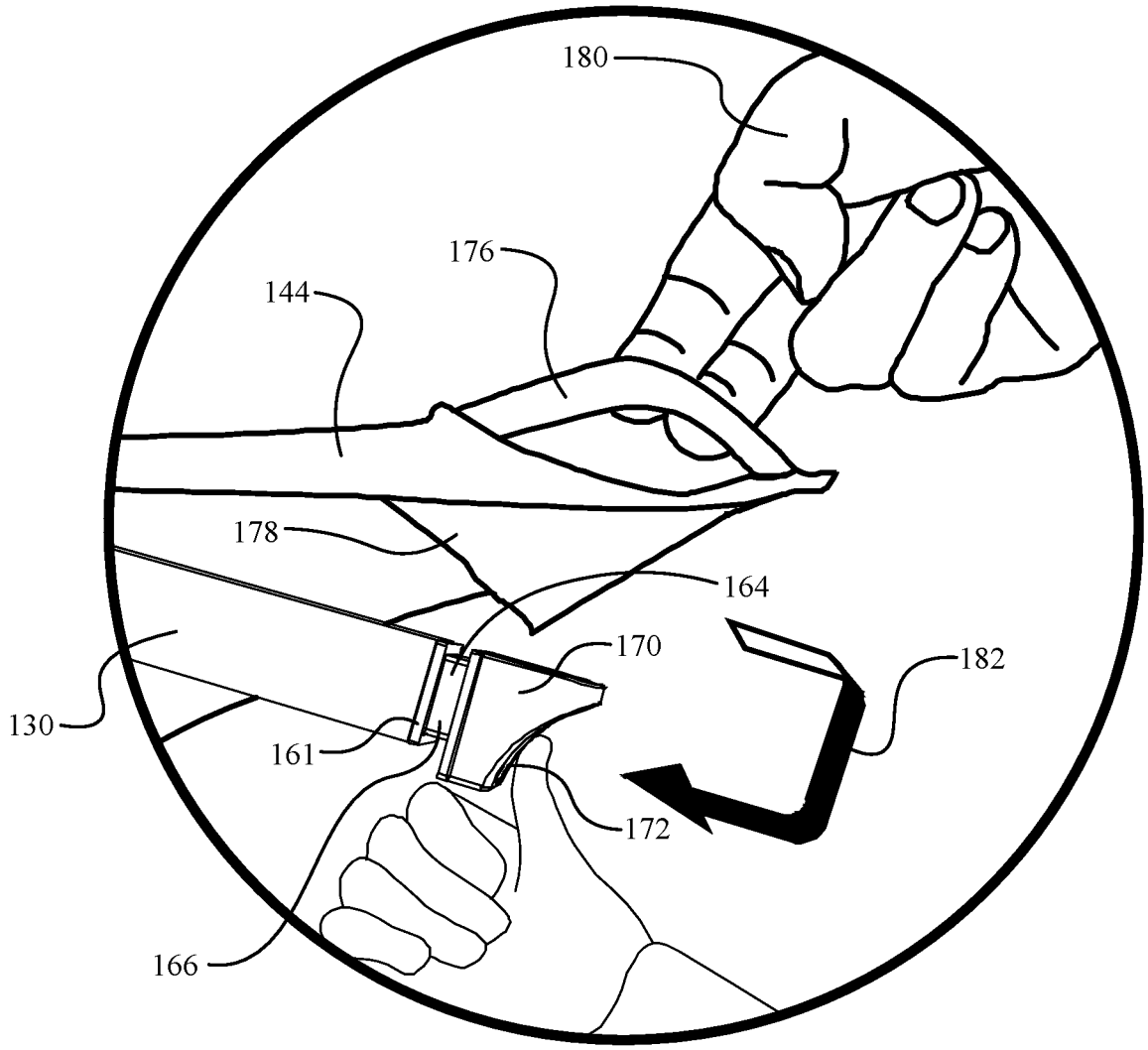
FIG. 15 is an enlarged, partial perspective view illustrating the manner in which a corner of the peripheral roof canopy portion in FIG. 1 is fitted over one of the spring-loaded plug inserts disposed in one of the corner roof frame members.

In addition, in the illustrative embodiment, the base member 152 of each spring-loaded plug insert 150 further comprises a peripheral rim 161 disposed on an end of the plurality of side walls that is opposite to the base wall 153 (see e.g., FIGS. 3 and 11). The peripheral rim 161 is configured to prevent the over-insertion of the base member 152 into the opening 131 of the roof frame member 130 of the outdoor shelter 100. For example, as shown in FIG. 12, the peripheral rim 161 of the base member 152 prevents the over-insertion of the spring-loaded plug insert 150 into the opening 131 of the roof frame member 130 because the peripheral rim 161 abuts the outer edge of the roof frame member 130 when the spring-loaded plug insert 150 is fully inserted into the roof frame member 130 (e.g., as shown in FIGS. 14 and 15). In FIG. 12, the insertion of the spring-loaded plug insert 150 into the opening 131 of the roof frame member 130 is diagrammatically represented by the directional arrow 174.

Figure 13A:
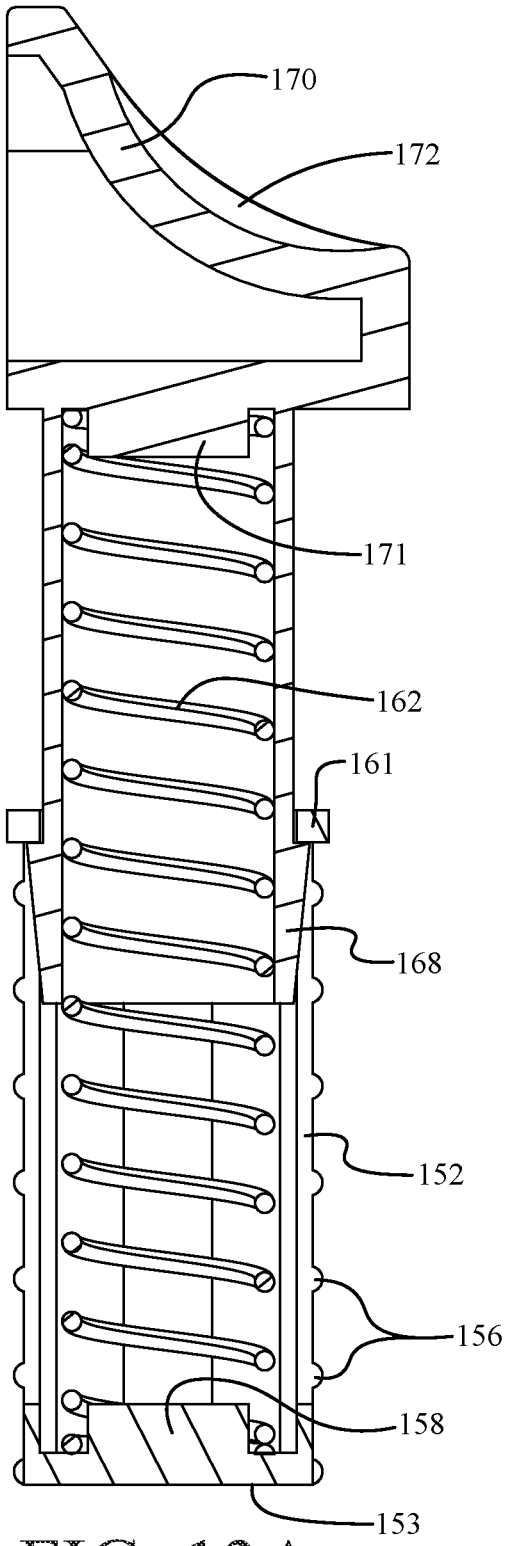
FIG. 13A is a cross-sectional view of the spring-loaded plug insert of FIG. 3, wherein the displaceable plug member of the spring-loaded plug insert is in an extended position relative to the base member of the spring-loaded plug insert.
Figure 13B:
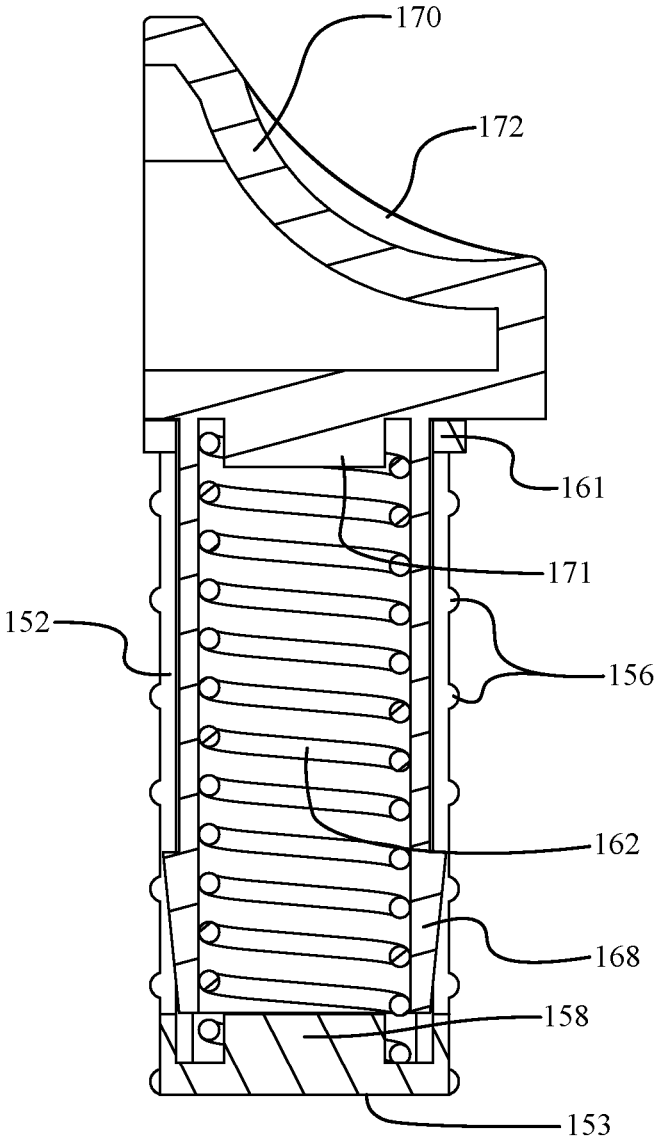
FIG. 13B is a cross-sectional view of the spring-loaded plug insert of FIG. 3, wherein the displaceable plug member of the spring-loaded plug insert is in a retracted position relative to the base member of the spring-loaded plug insert.

In the illustrative embodiment, as shown in FIGS. 11, 13A, and 13B, the base wall 153 of the base member 152 of each spring-loaded plug insert 150 comprises a first spring protrusion 158 extending outwardly from the base wall 153, and the displaceable plug member 164 comprises a second spring protrusion 171 extending outwardly from the displaceable plug member 164. As best shown in the sectional views of FIGS. 13A and 13B, a first end of the spring member 162 is supported by the first spring protrusion 158 of the base member 152 and a second end of the spring member 162 is supported by the second spring protrusion 171 of the displaceable plug member 164, wherein the first end of the spring member 162 is oppositely disposed relative to the second end of the spring member 162. In the illustrative embodiment, the first and second spring protrusions 158, 171 are in the form of cylindrical bosses that are fitted into the circular openings defined by the opposed ends of the spring member 162.

Next, referring again to the illustrative embodiment depicted in FIGS. 3, 4, and 11, the displaceable plug member 164 of each spring-loaded plug insert 150 will be explained in further detail. As shown in these figures, the displaceable plug member 164 further comprises a stem portion 166 attached to the end portion 170 of the displaceable plug member 164. Also, in the illustrative embodiment, the end portion 170 of the displaceable plug member 164 further comprises a curved surface defining a finger recess 172 for receiving a finger of the user (see e.g., FIG. 15) when the user displaces the displaceable plug member 164 to the retracted position. When the displaceable plug member 164 is displaced by the user to the retracted position, the spring member 162 is configured to be compressed (e.g., the compressed spring position of FIG. 13B).

In one exemplary embodiment, the spring-loaded plug insert 150 may have an overall length (i.e., when it is in its fully extended position of FIGS. 3 and 13A) of approximately 3.62 inches (approximately 92 millimeters) and the base member 152 of the spring-loaded plug insert 150 may have a length of approximately 1.57 inches (approximately 40 millimeters) from the outer surface of the base wall 153 to the inside surface of the peripheral rim 161. In other words, the install depth of the base member 152 of the spring-loaded plug insert 150 into the opening 131 of the roof frame member 130 may be approximately 1.57 inches (approximately 40 millimeters). Also, in the exemplary embodiment, when the spring-loaded plug insert 150 is in its fully extended position of FIGS. 3 and 13A, the exposed stem portion 166 of the displaceable plug member 164 between the outside surface of the peripheral rim 161 and the bottom ledge of the end portion 170 of the displaceable plug member 164 may have a length of approximately 1.0 inch (approximately 25 millimeters). In other words, the gap length between the outside surface of the peripheral rim 161 and the bottom ledge of the end portion 170 of the displaceable plug member 164 may be approximately 1.0 inch (approximately 25 millimeters). Further, in the exemplary embodiment, the cross-sectional dimensions of the base member 152 of the spring-loaded plug insert 150 may be approximately 0.78 inches (approximately 20 millimeters) by 0.78 inches (approximately 20 millimeters). That is, the base member 152 may have an approximately square cross-section that is approximately 0.78 inches (approximately 20 millimeters) by 0.78 inches (approximately 20 millimeters). Although, it is to be understood that the invention is in no way limited to these particular dimensions. Rather, the invention may be practiced using any other suitable dimensions without departing from the spirit and scope of the appended claims.

Figure 16:
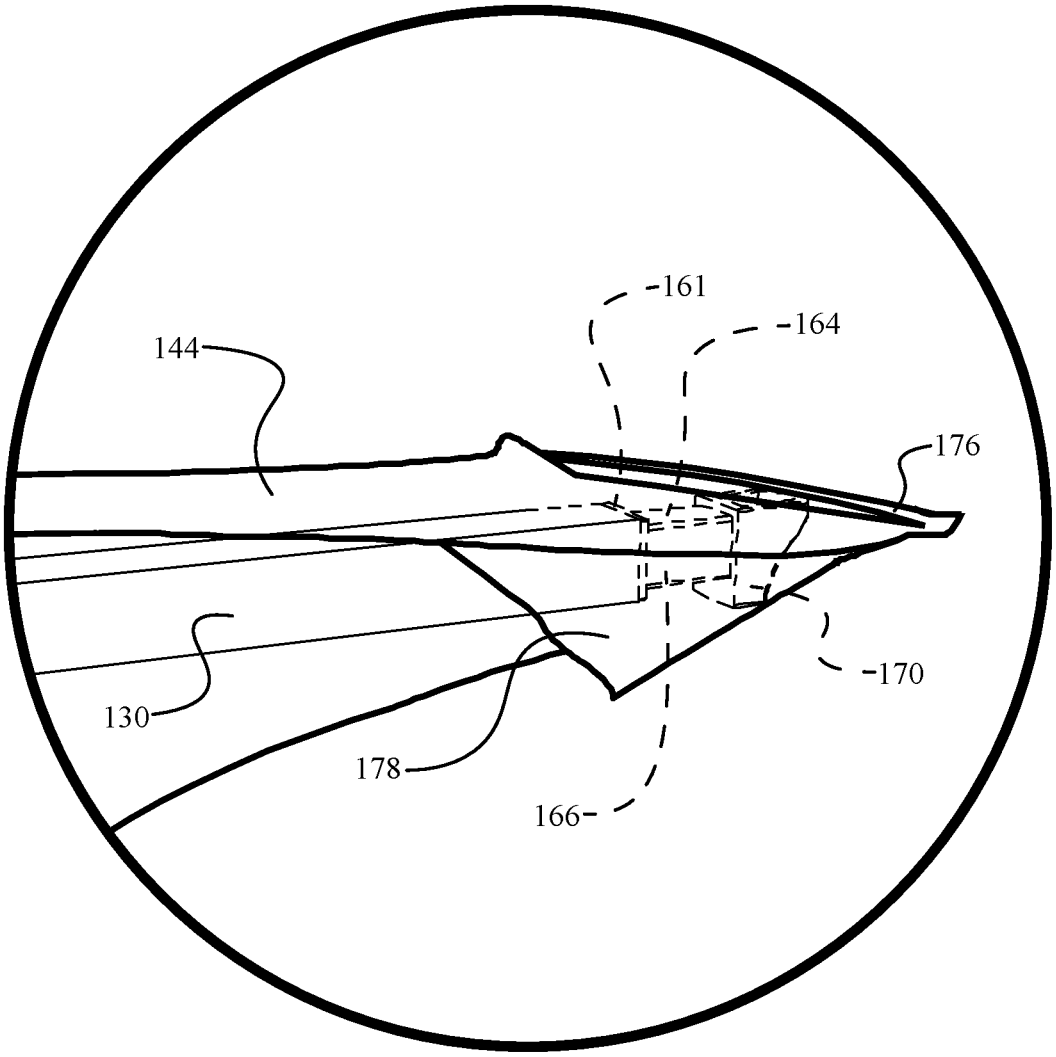
FIG. 16 is an enlarged, partial perspective view illustrating the corner of the peripheral roof canopy portion in FIG. 1 after it has been fitted over the spring-loaded plug insert disposed in the corner roof frame member.

Now, referring primarily to FIGS. 14-16, the manner in which the pocket structures 178 of the roof canopy 144 are fitted over the end portions of the roof frame members 130 by a user using the spring-loaded plug inserts 150 will be described. As shown in FIGS. 14 and 15, grasps the handle member 176 of the roof canopy portion 144 with his or her first hand 180, and elastically stretches the fabric of the roof canopy portion 144 while simultaneously pushing the displaceable plug member 164 of the spring-loaded plug insert 150 to a retracted position with a finger of his or her second hand, until the end portion of the roof frame member 130 with the spring-loaded plug insert 150 is able to be inserted into the pocket cavity of the pocket structure 178. Then, the end portion of the roof frame member 130 with the spring-loaded plug insert 150 is inserted into the pocket cavity of the pocket structure 178 (as indicated by the directional arrow 182 in FIG. 15). After which, the elasticity of the fabric that forms the roof canopy portion 144 allows the fabric to compress so that the end portion of the corner roof frame member 130 with the spring-loaded plug insert 150 is snugly received within the pocket cavity of the pocket structure 178 (refer to FIG. 16). In this manner, as shown in FIG. 16, the end portion 170 of the displaceable plug member 164 of the spring-loaded plug insert 150 attaches the roof canopy 144 to the roof frame member 130 of the outdoor shelter 100.

While the spring-loaded plug inserts 150 have been described primarily in conjunction with the peripheral roof canopy portion 144, it is to be understood that the small roof corner frame members 140 supporting the central roof canopy portion 146 may also be provided with spring-loaded plug inserts 150 disposed in the lower ends thereof so that the central roof canopy portion 146 may be installed in an easier manner as well.

It is readily apparent that the aforedescribed spring-loaded plug insert 150 and the outdoor shelter 100 including the same offer numerous advantages. First, the spring-loaded plug insert 150 facilitates the installation of the roof canopy 144, 146 on the roof frame members 130, 140 of the outdoor shelter 100. In addition, the outdoor shelter 100 described herein that includes the spring-loaded plug insert 150 enables a user to more easily assemble the outdoor shelter 100 in a shorter amount of time.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A spring-loaded plug insert for facilitating a fitting of a canopy over a frame member of an outdoor shelter, the spring-loaded plug insert comprising:

a base member defining a cavity, the base member configured to be inserted into an opening of the frame member of the outdoor shelter, the base member further comprising a base wall and a plurality of side walls extending outwardly from the base wall, at least one of the plurality of side walls comprising one or more rib members for creating a tighter fit between the base member and the opening of the frame member of the outdoor shelter, the base wall of the base member comprising a first spring protrusion extending outwardly from the base wall;

a displaceable plug member slidably received within the cavity of the base member, the displaceable plug member including an end portion for attaching to the canopy of the outdoor shelter, the displaceable plug member comprising a second spring protrusion extending outwardly from the displaceable plug member; and a spring member configured to bias the displaceable plug member in an extended position relative to the base member, a first end of the spring member being supported by the first spring protrusion of the base member and a second end of the spring member being supported by the second spring protrusion of the displaceable plug member, the first end of the spring member being oppositely disposed relative to the second end of the spring member;

wherein the displaceable plug member is configured to be displaced by a user to a retracted position relative to the base member in order to facilitate the fitting of the canopy over the frame member of the outdoor shelter.

2. The spring-loaded plug insert according to claim 1, wherein at least one of the plurality of side walls of the base member comprises a longitudinally extending slot formed therein, and the displaceable plug member comprises a protrusion slidingly received within the longitudinally extending slot of the base member; and wherein an engagement between the protrusion of the displaceable plug member and the longitudinally extending slot of the base member defines a range of the sliding movement of the displaceable plug member relative to the base member.

3. The spring-loaded plug insert according to claim 1, wherein the base member further comprises a peripheral rim disposed on an end of the plurality of side walls that is opposite to the base wall, the peripheral rim configured to prevent the over-insertion of the base member into the opening of the frame member of the outdoor shelter.

4. The spring-loaded plug insert according to claim 1, wherein the displaceable plug member further comprises a stem portion attached to the end portion of the displaceable plug member.

5. The spring-loaded plug insert according to claim 1, wherein the end portion of the displaceable plug member further comprises a curved surface defining a finger recess for receiving a finger of the user when the user displaces the displaceable plug member to the retracted position.

6. The spring-loaded plug insert according to claim 1, wherein, when the displaceable plug member is displaced by the user to the retracted position, the spring member is configured to be compressed.

7. An outdoor shelter, comprising:

at least one frame member having an opening;

a canopy configured to be supported by the at least one frame member; and a spring-loaded plug insert for facilitating a fitting of the canopy over the at least one frame member of the outdoor shelter, the spring-loaded plug insert comprising:

a base member defining a cavity, the base member configured to be inserted into the opening of the at least one frame member of the outdoor shelter, the base member further comprising a base wall and a plurality of side walls extending outwardly from the base wall, at least one of the plurality of side walls comprising one or more rib members for creating a tighter fit between the base member and the opening of the frame member of the outdoor shelter, the base wall of the base member comprising a first spring protrusion extending outwardly from the base wall;

a displaceable plug member slidably received within the cavity of the base member, the displaceable plug member including an end portion for attaching to the canopy of the outdoor shelter, the displaceable plug member comprising a second spring protrusion extending outwardly from the displaceable plug member; and a spring member configured to bias the displaceable plug member in an extended position relative to the base member, a first end of the spring member being supported by the first spring protrusion of the base member and a second end of the spring member being supported by the second spring protrusion of the displaceable plug member, the first end of the spring member being oppositely disposed relative to the second end of the spring member;

wherein the displaceable plug member is configured to be displaced by a user to a retracted position relative to the base member in order to facilitate the fitting of the canopy over the at least one frame member of the outdoor shelter.

8. The outdoor shelter according to claim 7, wherein at least one of the plurality of side walls of the base member of the spring-loaded plug insert comprises a longitudinally extending slot formed therein, and the displaceable plug member comprises a protrusion slidingly received within the longitudinally extending slot of the base member; and wherein an engagement between the protrusion of the displaceable plug member and the longitudinally extending slot of the base member defines a range of the sliding movement of the displaceable plug member relative to the base member.

9. The outdoor shelter according to claim 7, wherein the base member of the spring-loaded plug insert further comprises a peripheral rim disposed on an end of the plurality of side walls that is opposite to the base wall, the peripheral rim configured to prevent the over-insertion of the base member into the opening of the at least one frame member of the outdoor shelter.

10. The outdoor shelter according to claim 7, wherein the displaceable plug member of the spring-loaded plug insert further comprises a stem portion attached to the end portion of the displaceable plug member.

11. The outdoor shelter according to claim 7, wherein the end portion of the displaceable plug member of the spring-loaded plug insert further comprises a curved surface defining a finger recess for receiving a finger of the user when the user displaces the displaceable plug member to the retracted position.

12. The outdoor shelter according to claim 7, wherein, when the displaceable plug member of the spring-loaded plug insert is displaced by the user to the retracted position, the spring member of the spring-loaded plug insert is configured to be compressed.

13. The outdoor shelter according to claim 7, wherein the canopy further comprises at least one pocket structure, the at least one pocket structure defining a pocket cavity configured to receive the end portion of the displaceable plug member of the spring-loaded plug insert therein.

14. The outdoor shelter according to claim 7, wherein the canopy of the outdoor shelter comprises a roof canopy, the at least one frame member of the outdoor shelter comprises a roof frame member, and the end portion of the displaceable plug member attaches the roof canopy to the roof frame member of the outdoor shelter.

15. An outdoor shelter, comprising:

at least one frame member having an opening;

a canopy configured to be supported by the at least one frame member, the canopy further comprising at least one pocket structure, the at least one pocket structure including a pocket fabric sheet at least partially spaced apart from a canopy fabric material, the pocket fabric sheet and the canopy fabric material together defining a pocket cavity; and a spring-loaded plug insert for facilitating a fitting of the canopy over the at least one frame member of the outdoor shelter, the spring-loaded plug insert comprising:

a base member defining a cavity, the base member configured to be inserted into the opening of the at least one frame member of the outdoor shelter, the base member further comprising a base wall and a plurality of side walls extending outwardly from the base wall, the base wall of the base member of the spring-loaded plug insert comprising a first spring protrusion extending outwardly from the base wall;

a displaceable plug member slidably received within the cavity of the base member, the displaceable plug member including an end portion for attaching to the canopy of the outdoor shelter, the displaceable plug member comprising a second spring protrusion extending outwardly from the displaceable plug member; and a spring member configured to bias the displaceable plug member in an extended position relative to the base member, a first end of the spring member being supported by the first spring protrusion of the base member and a second end of the spring member being supported by the second spring protrusion of the displaceable plug member, the first end of the spring member being oppositely disposed relative to the second end of the spring member;

wherein the displaceable plug member is configured to be displaced by a user to a retracted position relative to the base member in order to facilitate the fitting of the canopy over the at least one frame member of the outdoor shelter; and wherein the pocket cavity of the at least one pocket structure of the canopy is configured to receive the end portion of the displaceable plug member of the spring-loaded plug insert therein.

16. The outdoor shelter according to claim 15, wherein the end portion of the displaceable plug member of the spring-loaded plug insert further comprises a curved surface defining a finger recess for receiving a finger of the user when the user displaces the displaceable plug member to the retracted position.

17. The outdoor shelter according to claim 15, wherein, when the displaceable plug member of the spring-loaded plug insert is displaced by the user to the retracted position, the spring member of the spring-loaded plug insert is configured to be compressed.

18. The outdoor shelter according to claim 15, wherein the canopy of the outdoor shelter comprises a roof canopy, the at least one frame member of the outdoor shelter comprises a roof frame member, and the end portion of the displaceable plug member attaches the roof canopy to the roof frame member of the outdoor shelter.

* * * * *